US006738029B2

(12) United States Patent
Lang et al.

(10) Patent No.: US 6,738,029 B2
(45) Date of Patent: May 18, 2004

(54) REFLECTIVE FILM DISPLAY DEVICE THAT IS ELECTROMECHANICALLY ACTUATED, METHOD OF MANUFACTURING THE SAME, AND METHOD OF MANUFACTURING CANTILEVER FOR DISPLAY FOR REFLECTIVE FILM DISPLAY DEVICE

(75) Inventors: Richard Lang, Tokyo (JP); Atsushi Sugahara, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 484 days.

(21) Appl. No.: 09/891,280

(22) Filed: Jun. 27, 2001

(65) Prior Publication Data

US 2001/0054987 A1 Dec. 27, 2001

(30) Foreign Application Priority Data

Jun. 27, 2000 (JP) ..... 2000-192759

(51) Int. Cl.[7] ..... G09G 5/00
(52) U.S. Cl. ..... 345/4; 345/1.1
(58) Field of Search ..... 345/4, 5, 6, 1.1, 345/1.2, 7, 8, 85, 86, 108; 29/602.1, 44; 72/388

(56) References Cited

U.S. PATENT DOCUMENTS 4,248,501 A * 2/1981 Simpson ..... 359/227
4,420,897 A * 12/1983 Castleberry ..... 40/427
4,831,371 A * 5/1989 Hata ..... 345/85
4,891,635 A * 1/1990 Hata ..... 345/85
5,943,033 A 8/1999 Sugahara et al.
6,130,656 A 10/2000 Sugahara

FOREIGN PATENT DOCUMENTS

JP 63-47388 3/1888

* cited by examiner

*Primary Examiner*—Richard Hjerpe
*Assistant Examiner*—Ronald Laneau
(74) *Attorney, Agent, or Firm*—Oblon, Spivak, McClelland, Maier & Neustadt, P.C.

(57) ABSTRACT

In a reflective film display device, a platform has a covered stationary electrode mounted thereon, which holds a plurality of movable cantilevers in substantially a plane, and fixing a wiring board. The platform includes an aligning slit for accurately connecting a conducting line on the wiring board to the stationary electrode and to the movable cantilever that can be elastically bent and a through-hole for aligning the position of the platform with another platform. The cantilever having a tab at its free end is electrically separated from the stationary electrode on the platform and a gap is provided between the free end of the cantilever and the stationary electrode. A plurality of platforms are stacked one upon the other by utilizing the through-holes of the platforms so as to allow the tabs to be arranged to form a grid.

6 Claims, 6 Drawing Sheets

REFLECTIVE FILM DISPLAY DEVICE THAT IS ELECTROMECHANICALLY ACTUATED, METHOD OF MANUFACTURING THE SAME, AND METHOD OF MANUFACTURING CANTILEVER FOR DISPLAY FOR REFLECTIVE FILM DISPLAY DEVICE

CROSS-REFERENCE TO RELATED APPLICATIONS

This application is based upon and claims the benefit of priority from the prior Japanese Patent Application No. 2000-192759, filed Jun. 27, 2000, the entire contents of which are incorporated herein by reference.

BACKGROUND OF THE INVENTION

The present invention relates to a reflective film display device that is electromechanically actuated, the method of manufacturing the same, and a method of manufacturing a cantilever for display for the reflective film display device, particularly, to an electromechanically actuated reflective film display device forming a plurality of black, white or colored tabs that engender text and images, in which a large number of electromechanically actuated film devices are two dimensionally arranged to form a grid or matrix, the manufacturing method thereof, and a method of manufacturing a cantilever for display for the reflective film display device.

These display devices, called "actuated film displays" (AFD or AFD's), offer features such as a paper-like white appearance, low power consumption, quick response and good color performance.

Display manufacturers have long aspired to supply customers with large hang-on-the-wall televisions and electronic information boards at affordable prices. Various technologies that offer excellent optical properties are already available on the market but most of these are limited in size and none is yet able to satisfy the low cost requirements. The present invention is intended to make possible the fabrication of thin and light displays in any size and at low cost, without compromising on highly desirable qualities such as a high contrast ratio, an excellent color gamut, a wide viewing angle, quick response and low energy consumption.

Before describing the present invention, we will briefly discuss the advantages and problems associated with other well-known type of display.

A liquid crystal display (LCD) is a panel technology which is, by far, the most widely used to create thin and light reflective as well as transmissive display devices. Most reflective LCD's tend to produce dark images due to the inclusion of polarizers and can only offer faded colors due to a low contrast ratio. They are therefore used in a variety of applications, such as watches, portable phones, game consoles or electric appliances, where brightness and color quality are sacrificed in order reduce manufacturing costs as much as possible and increase mobility and battery life. Applications that require much higher quality images and extended viewing periods of time and where costs are not crucial will rather include transmissive LCD's. They have completely dominated the portable notebook computer market for several years already and have even started to penetrate the desktop display market as manufacturing yields have improved and prices have gone down. The most common LCD device usually comprises a glass cell confining a layer of liquid crystal in the twisted nematic (TN) configuration. LCD's can, without a doubt, claim to offer the near-perfect solution for notebook computers due to their light weight, thin frame, wide range of colors, high resolution and crisp text quality. Current TFT LCD's are still relatively expensive when compared to cathode ray tubes (CRT's) due to the large number of TFT manufacturing processes involved and yield consideration. Despite this, they are in great demand since they allow complete mobility. It remains doubtful however if they will ever become a viable solution for very large displays since manufacturing defects are far more likely to appear in larger cells (the larger the surface, the higher the probability of various deficiencies to appear), therefore causing production yields to decrease significantly and costs to sky-rocket. While it can be expected that very large LCD's will find a niche in the corporate market, radically inexpensive manufacturing processes will have to be developed in order for them to compete with large CRT's. Efforts have been made to assemble a series of smaller and cheaper LCD's to form a larger one by using seamless technology (the edge of each display is rendered invisible) but with limited success so far.

While size may be considered as the most pressing problem to be solved in the near future, it is certainly not the only hurdle limiting the range of LCD applications. The response time of the most commonly used liquid crystals, i.e., the liquid crystals that offer the best optical performance, also tends to be rather slow. This means that when movies or television broadcasts are shown, ghost-like halos trail moving objects and details of continuously changing images become blurred. Therefore, new cell structures and liquid crystals suitable for fast switching (while maintaining current optical properties) need to be developed.

The second most widely manufactured flat panel display technology, albeit in much smaller volumes than LCD's, is of the plasma display. These can be fabricated in large sizes and offer ideal optical properties such as a wide range of colors, a high contrast, a wide viewing angle as well as a quick response. Plasma displays consumes a lot of power, however, in order to provide sufficient luminance. They are also considerably heavier and bulkier than equivalent-sized LCD's, characteristics that are fatal problems as far as the notebook computer market is concerned. As for large-sized displays, production costs are still extremely high and they are not expected to be a serious rival to CRTs for many years to come.

The field emissive display (FED) is considered by many to be the technology that has the best chance of replacing all CRT's with thin and light displays offering superior optical properties. FED's basically includes a glass panel supporting an array of microscopic conically shaped tip electrodes which can be induced to emit electrons when submitted to an intense electric field. In a process that greatly resembles the techniques used in common cathode ray tubes of televisions, the emitted electrons then serve to bombard patterned phosphors which in turn emit red, green or blue light. Displays of a small size have been fabricated successfully but it is still unclear if manufacturers will be able to fabricate large displays at affordable price.

Further, the present inventor has already proposed a novel movable film type display device in Japanese Patent Disclosure (Kokai) No. 8-271933. The movable film type display device of the noble construction comprises a movable cantilever supporting a tab (display piece) and fixed at one end portion with the other end portion made movable and a stationary electrode. A gap is formed between the movable cantilever and the stationary electrode in this display device. The movable cantilever is moved within the gap by the electrostatic force generated between the movable cantilever and the stationary electrode so as to allow the background of the tab (folded piece) supported by the movable cantilever to perform the function of the display region. To be more specific, when the tab is moved to expose the background of the tab to the outside, the background can be seen from the outside, thereby allowing it to perform the function of the display region. In the movable film type display device of this type, the structures described above are arranged in the row and column directions and each tab is moved independently so as to make it possible to display an image.

In the movable film type display device in which a large number of electromechanically movable members are arranged, it is necessary to stack the electromechanically movable structures one upon the other. For the arrangement of the electromechanically movable structures, an accurate alignment is required. Therefore, proposals of the structure adapted for the manufacture and novel manufacturing method and apparatus are awaited.

As described above, thin and lightweight display devices having good optical characteristics are already available on the market. However, it is difficult to manufacture a large display device at a low cost with the present technology, and another method for overcoming this hurdle is awaited.

A display device having a high resolution or a large size comprises a very large number of pixels. If the pixels are manufactured one by one, a very large number of manufacturing steps are required, with the result that the number of pixels manufactured in a predetermined time is very small, leading to a very high manufacturing cost. Particularly, the proposed movable film type display device structure makes it possible to realize a large display device having a high resolution. However, an accurate alignment is required. Since it is necessary to stack a large number of electromechanically movable structures one upon the other, required is the technology for stacking the electromechanically movable structures one upon the other efficiently and accurately.

BRIEF SUMMARY OF THE INVENTION

An object of the present invention is to provide a reflective film display device that permits stacking a large number of electromechanically movable structures one upon the other accurately and efficiently and a method of manufacturing the particular reflective film display device.

Another object of the present invention is to provide a reflective film display device that permits stacking a large number of electromechanically movable structures capable of providing a screen or display area offering features such as a paper-like white appearance, low power consumption, quick response and good color performance one upon the other accurately and efficiently and a method of manufacturing the particular reflective film display device.

Further, still another object of the present invention is to provide a method of manufacturing a cantilever for display for the reflective film display device efficiently and with a high accuracy.

According to a first aspect of the present invention, there is provided a reflective film display device including first and second display units to which a driving signal is supplied, the second display unit being stacked on the first display unit, and each of the first and second display units comprising:

a stationary electrode;

a plurality of movable cantilevers, each configured to be elastically deformed, electrically insulated from the stationary electrode, having a first free end and a movable display piece provided at the first free end, and being arranged to have a gap between the first free end and the stationary electrode;

a wiring board including conducting lines configured to supply the driving signal to the stationary electrode and the movable cantilevers;

a plurality of stationary cantilevers, each having a second free end and a stationary display piece provided at the second free end and arranged on the corresponding movable cantilever, the stationary display piece facing to the movable display piece with a gap between the stationary display piece and the movable display piece; and an alignment structure configured to align the second display unit with the first display unit, to hold the movable and stationary cantilevers substantially in an array and to fix the wiring board to the stationary electrode, the alignment structure including a first aligning member connecting the conducting lines to the stationary electrode and the movable cantilever and a second aligning member positioning the second display unit on the first display unit such that the movable and stationary display pieces of the first and second display units are arranged to form a grid, and the movable cantilever being bent upon application of the driving signal to the conducting lines such that the movable display piece of the second display unit is displaced to a position behind the stationary display piece of the first display unit.

According to a second aspect of the present invention, there is provided a reflective film display device including first and second display units to which a driving signal is supplied, the second display unit being stacked on the first display unit, and each of the first and second display units comprising:

an alignment structure configured to align the second display unit with the first display unit;

a stationary electrode provided on the alignment structure;

movable cantilevers, each configured to elastically deformed and having a movable display piece at its free end, a first gap being formed between the free end of the movable cantilever and the stationary electrode, the movable cantilevers being fixed to the alignment structure;

stationary cantilevers, each mounted on the movable cantilever in conformity with the movable cantilever and having a stationary display piece provided at a free end, a second gap being provided between the movable and stationary display pieces; and a wiring configured to supply a driving signal to the stationary electrode and the movable cantilever, the wiring being aligned with the stationary electrode and the movable cantilever by the alignment structure, and the movable cantilever being elastically deformed to allow the movable display piece of the second display unit to be displaced to a position behind the stationary display piece of the first display unit.

According to a third aspect of the present invention, there is provided a method of manufacturing a reflective film display device, comprising:

preparing first and second display units, each including:

preparing a wiring board having conducting lines configured to be applied with voltage signals;

preparing a alignment structure having a stationary electrode and including a receiving section and first and second position aligning members;

fitting the wiring board in the receiving section to fix the wiring board on the alignment member, one of the conducting lines being electrically connected to the stationary structure;

arranging movable cantilevers in a predetermined array on a mount base, each of the movable cantilevers configured to elastically deformed and having a free end portion which is folded to provide a movable display piece;

positioning the first alignment member on the mount base to align the conducting lines with the corresponding movable cantilevers, respectively, fixing the movable cantilevers on the alignment structure to provide gaps between the movable cantilevers and the stationary electrode, respectively, and removing the alignment structure from the mount base; and mounting stationary cantilevers on the movable cantilevers, respectively, each of the stationary cantilevers having a free end which is folded to provide a stationary display piece, and fixing the stationary cantilevers on the movable cantilevers to provide gaps between the movable and stationary display pieces; and positioning the second alignment member of the second display unit on the first display unit to align the movable cantilevers of the second display unit to the corresponding stationary cantilevers of the first display unit, the stationary and movable display pieces being arranged in a grid and the movable cantilever being bent upon application of the voltage signal to displace the movable display piece of the second display unit to a position behind the stationary display piece of the first display unit.

Further, according to a fourth aspect of the present invention, there is provided a method of manufacturing a cantilever for display for a reflective film display device, comprising:

preparing a rectangular resin film coated with a conductive layer;

cutting the rectangular resin film to form a plurality of strip-like movable cantilevers extending substantially in parallel to each other and having a free end portion each;

preparing a pair of blocks, each having a holding surface and a slidable surface, and arranging the pair of blocks such that the holding surfaces face each other and the slidable surfaces aligned in a reference plane;

holding the movable cantilevers substantially in parallel to each other between the holding surfaces of the blocks to project the free end portions of the movable cantilever from the reference plane;

preparing a press member having a flat smooth surface and sliding the press member on the slidable surfaces of the blocks to fold the free end portions of the movable cantilever and to allow the pressurizing member to press the free end portion against one of the slidable surfaces, and heating the movable cantilevers with the free end portion thus pressed; and gradually cooling the movable cantilever and releasing the movable cantilever from the blocks.

DETAILED DESCRIPTION OF THE INVENTION

A reflective film display device according to one embodiment of the present invention will now be described with reference to the accompanying drawings.

Specific examples of a reflective film display device according to one embodiment of the present invention, the manufacturing method thereof, and a method of manufacturing a cantilever for display for the reflective film display device will now be described with reference to FIGS. 1 to 12.

Before describing the film reflective display device according to one embodiment of the present invention, the principle of the film reflective display device will now be described with reference to FIGS. 1 and 2.

Figure 1A:
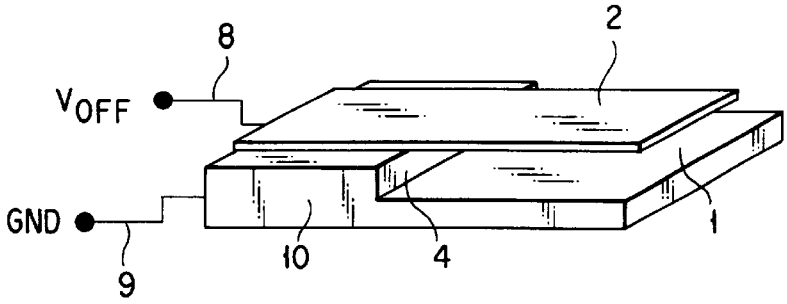
FIGS. 1A and 1B are oblique views schematically showing the operating principle of the display device of the present invention, which basically consists of a combination of a stationary electrode and a thin flexible cantilever.
Figure 1B:
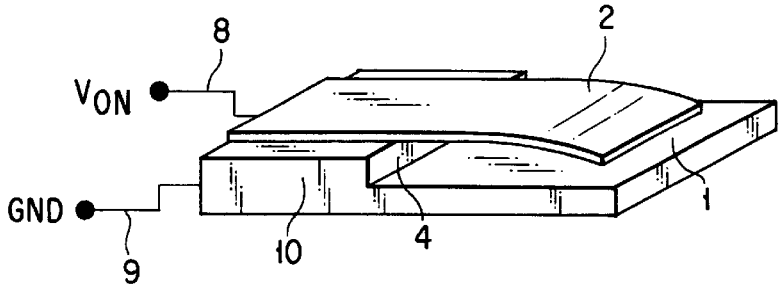

As shown in FIGS. 1A and 1B, deformable cantilevers 2 are mounted to face a rigid stationary electrode 1. The proximal end portion of the cantilever 2 is fixed to an insulating spacer 10 mounted on the stationary electrode 1 such that the free end portion of the cantilever 2 is mobile. Therefore, a gap 4 corresponding to the spacer 10 is provided between the cantilever 2 and the stationary electrode 1 so as to permit the free end portion of the cantilever 2 to be mobile within the gap 4. The stationary electrode 1 is fabricated from the molding of a polymer which is then covered with a conductive film, followed by covering the conductive film with an insulating layer. The cantilever 2 is fabricated from thin PET (polyethylene terephthalate) films covered with an Al layer on both sides to create electrodes and to minimize curvature. A signal line 8 and a ground line 9 are electrically connected to the conductive portions of the cantilever 2 and to the stationary electrode 2, respectively.

When a zero volts signal is applied to the signal line 8 ($V=V_{off}$), the cantilever 2 remains at its rest position. When a voltage pulse is sent through the signal line 8 ($V=V_{on}$), the cantilever 2 bends toward the stationary electrode 1 due to the electrostatic force between the cantilever 2 and the stationary electrode 1.

Figure 2A:
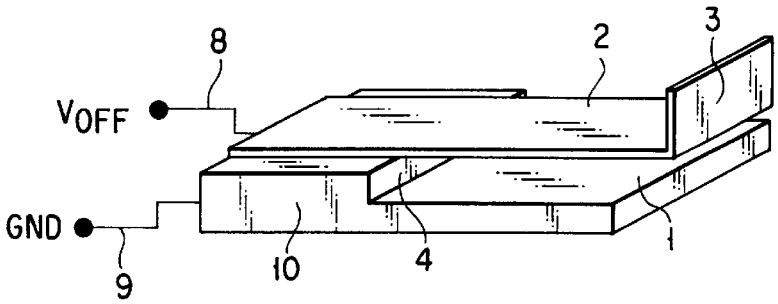
FIGS. 2A and 2B are oblique views schematically showing that the display state can be changed by the operating principle similar to that shown in FIG. 1 in the display device of the present invention, which basically consists of a combination of a stationary electrode and a thin flexible cantilever.
Figure 2B:
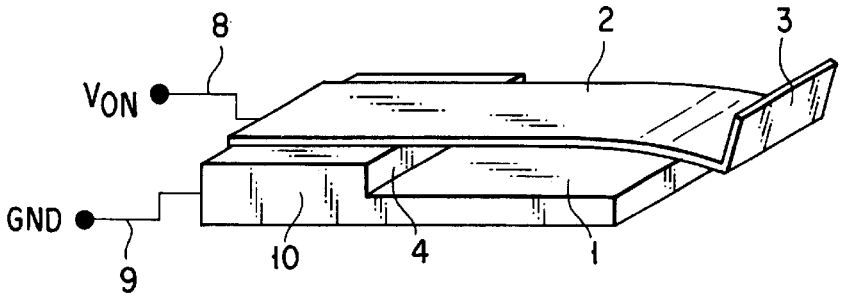
Figure 3A:
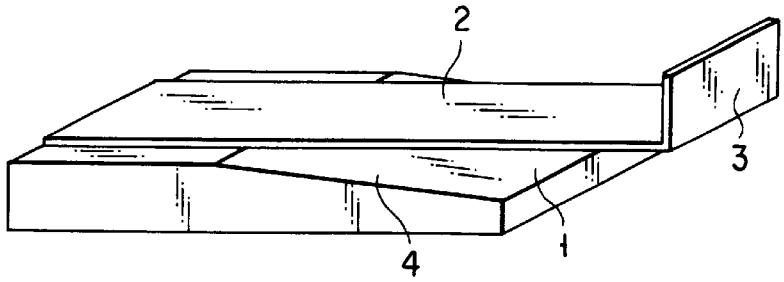
FIGS. 3A and 3B are oblique views showing a display device according to a modification of the display device shown in FIG. 2, the display device including an inclined stationary electrode.
Figure 3B:
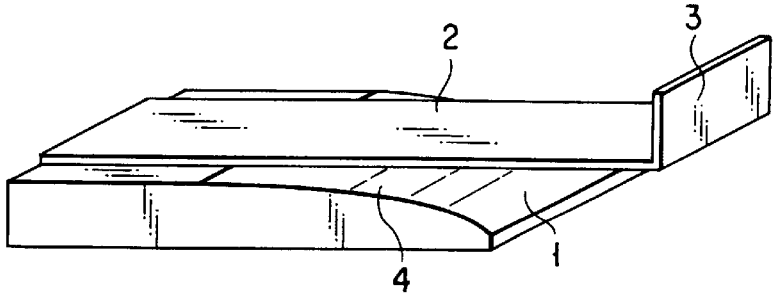

FIGS. 2A and 2B show the electrode structure, in which a colored movable tab 3, i.e., a folded piece acting as a display piece, is mounted on the tip of the cantilever 2 of the electrode structure shown in FIG. 1. The movable tab 3 is folded at substantially right angles relative to the cantilever 2 forming the base portion of the movable tab 3. Alternatively, it is possible to form a folded portion, which can be visually recognized, at the free end of the cantilever 2 so as to provide the tab 3. FIG. 3A shows a modification of the electrode structure, in which the surface of the stationary electrode 1 is inclined relative to the cantilever 2. On the other hand, FIG. 3B shows another modification of the electrode structure, in which the surface of the stationary electrode 1 forms a curved slope. As is apparent from the comparison between FIGS. 1A and 1B or between FIGS. 2A and 2B, the cantilever 2 is not deformed if a zero volts signal ($V=V_{off}$) is supplied to the signal line 8, with the result that the surface of the tab 3 faces the front side, i.e., a viewer side. On the other hand, if a voltage pulse ($V=V_{on}$) is supplied to the signal line 8, the cantilever 3 is bent so as to allow the surface of the tab 3 to be shifted and inclined.

Figure 4A:
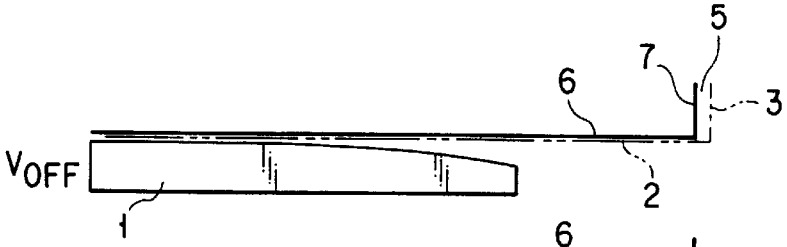
FIGS. 4A and 4B are oblique views showing that the display state can be changed by utilizing a tab, and the operating principle similar to that shown in FIG. 1 in a display device of the present invention that basically utilizes the combination of a stationary electrode, a flexible cantilever having a tab formed in the tip, and a stationary cantilever having a tab.
Figure 4B:
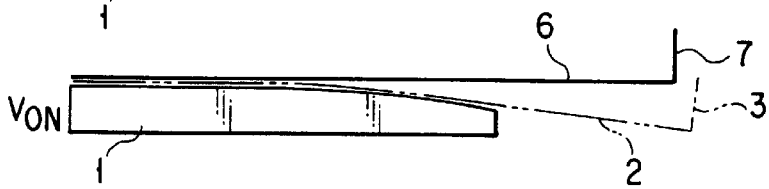

In the case of forming a pixel by using the electrode structure described above, a stationary cantilever 6 having a second tab, i.e., a stationary tab 7 formed at the tip is fixed to the stationary electrode 1 in addition to the mobile cantilever 2, as shown in FIGS. 4A and 4B. The mobile cantilever 2 and the stationary cantilever 6 are substantially equal to each other in the width, and the first tab 3 and the second tab 7 are substantially equal to each other in size, or the first tab 3 is slightly larger than the second tab 7. The first tab 3 of the mobile cantilever 2 is covered with an ink of a certain color, the second tab 7 of the stationary cantilever 6 is covered with an ink of another color. These two cantilevers 2 and 6 are fixed to the stationary electrode 1 such that the mobile cantilever 2 is held between the stationary cantilever 6 and the stationary electrode 1 and that a gap 5 is generated between the movable and stationary tabs 3 and 7 mounted on the tips of the cantilevers 2 and 6.

When a zero volts signal ($V=V_{off}$) is supplied to the mobile cantilever 2, the mobile cantilever 2 is not deformed so as to be retained in its rest position, as shown in FIG. 4A. If the outer surface of the tab 3 is white, only the white color can be seen as the pixel from the outside. If a pulse signal ($V=V_{on}$) is supplied to the mobile cantilever 2, the cantilever 2 is deformed toward the stationary electrode 1 as shown in FIG. 4B, with the result that the movable tab 3 at the tip of the cantilever 2 is displaced. It should be noted that the cantilever 6 is not deformed. It follows that the stationary tab 7 mounted on the tip of the cantilever 6, which is concealed behind the tab 3, comes to be seen. If the outer surface of the stationary tab 7 is, for example, black, the stationary tab 7 comes to be seen as a black pixel.

Figure 5:
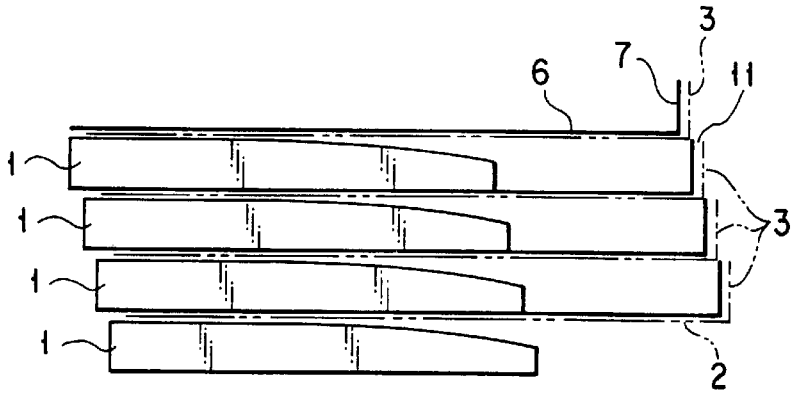
FIG. 5 is a side view schematically showing the display device according to one embodiment of the present invention, the display device being prepared by stacking a plurality of display structures shown in FIG. 4 one upon the other.

The actual display device is of a stacked structure in which a plurality of combined structures each consisting of the cantilevers 2, 6 and the stationary electrode 1 are stacked one upon the other as shown in FIG. 5. It should be noted that, when the mobile cantilever 2 is deformed to displace the tab 3 mounted at the tip thereof, a gap 11 is created between the displaced tab 3 and the stationary tab 7 such that the displaced tab 3 can be located behind the tab 7 of the adjacent stationary cantilever 6, and the units noted above are arranged slightly deviated from each other in the longitudinal direction so as to form the gap 11. The gap 11 is related to the range of deformation of the mobile cantilever 2. Also, the range of deformation of the mobile cantilever 2 is related to the curved slope on the surface of the stationary electrode 1. It follows that it is necessary to determine appropriately the shape of the slope so as to permit the deformation of the mobile cantilever 2.

Figure 6:
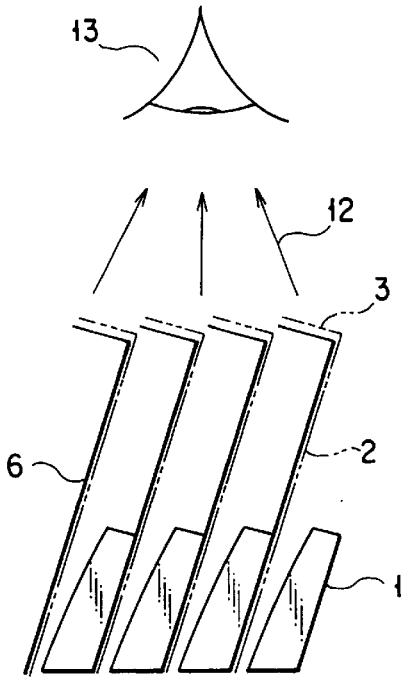
FIG. 6 is a drawing showing that a flat display can be obtained by inclining the display device of the stacked structure shown in FIG. 4.
Figure 7:
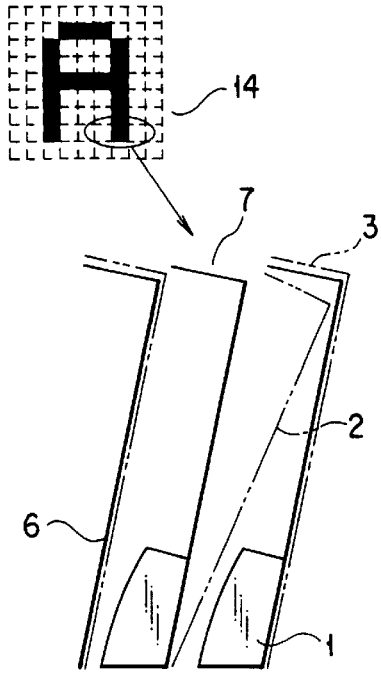
FIG. 7 is a drawing showing that the display device of the stacked structure shown in FIG. 5 is capable of displaying a monochromatic image.

In actually using the display device as shown in FIG. 6, the combined structures are stacked one upon the other in an inclined fashion, with the result that the movable and stationary tabs 3 and 7 seemingly constitute a plain screen or display area. If voltage is not applied to any of the mobile cantilevers 6 (if zero volts is maintained), the screen is seen to be of the same color, e.g., a white screen, because the reflected light rays 12 are white light rays. On the other hand, where a pulse voltage ($V=V_{on}$) is applied to specified cantilevers 6, the movable tab 3 is displaced so as to allow the stationary tab 7 behind the movable tab 3 to be seen as shown in FIG. 7. It follows that a desired pattern, e.g., letter "A", can be displayed by suitably combining the pixels to which the pulse voltage is applied.

If a pulse voltage ($V=V_{on}$) having a relatively high frequency is applied to the mobile cantilever 6, the cantilever is vibrated in accordance with the frequency of the pulse voltage, with the result that the movable tab 3 is vibrated over the entire surface of the stationary tab 7 so as to allow the background color, e.g., black, to appear periodically. The brightness is changed by the vibration of the movable tab 3 and the afterimage effect of the human eye so as to allow the displayed letter to be seen as, for example, a gray letter. It is possible to control the brightness by changing the frequency of the pulse voltage ($V=V_{on}$). Also, if colored tags of three primary colors are prepared in addition to the monochromatic tags, it is possible to display images, letters, patterns, etc. of a desired color by suitably shifting the tags.

Figure 8:
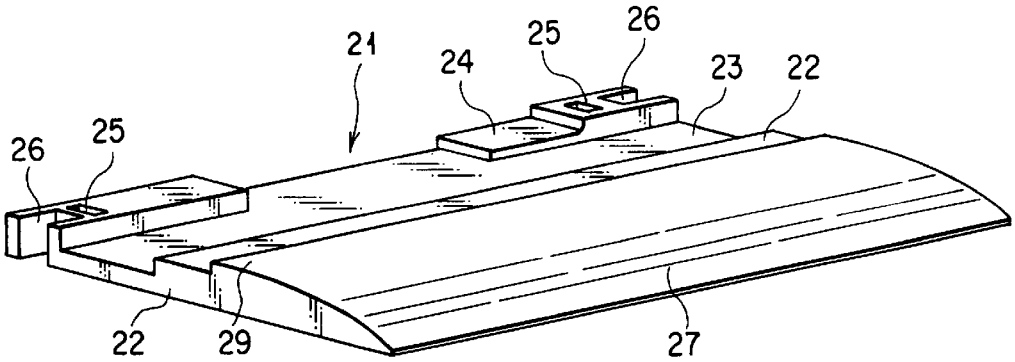
FIG. 8 is an oblique view showing a platform adapted for the manufacture of a display device of a stacked structure as shown in FIG. 5.

FIG. 8 shows a rigid platform 21 for realizing the movable film type display device shown in FIGS. 6 and 7. If the particular movable film type display device is to be realized, the pixel, i.e., the movable and stationary tabs 3 and 7, has a size of only about hundreds of microns. In other words, it is necessary to align and assemble the parts of the display device accurately with values of scores of microns. In order to fix all the parts appropriately in a mutually related fashion, it is necessary to use the rigid platform 21 as shown in FIG. 8. If the platform of the particular construction is not used, it is difficult to assemble the movable film type display device. In other words, the movable film type display device can be assembled with a high accuracy and efficiency by using the rigid platform 21 as shown in FIG. 8.

The platform 21 shown in FIG. 8 is constructed to permit electrical connection of the parts of the movable film type display device, to make alignment of these parts, and to assemble easily these parts and is also constructed to be manufactured through several steps that can be prepared easily by the molding of a polymer. A thin metal film corresponding to the stationary electrode 1 shown in FIGS. 1 to 7 is attached to a curved surface section 27 of the platform 21, and an insulating layer is formed on the curved surface section 27. The platform 21 also comprises a flat section 29 contiguous to the curved surface section 27. A first step 22 extending in the longitudinal direction of the flat section 29 is formed in the proximal end portion of the flat section 29. The inner surface of the first step 22 is formed flat. As described herein later, a double-sided tape is attached to the inner surface of the first step 22 and the stationary side of the movable cantilever 2 described previously is fixed to the double-sided tape.

A second step structure 23, which is a groove, is formed contiguous to the first step 22 in the platform 21. The second step structure 23 also has a flat inner surface extending along the flat surface of the first step 22. As described herein later, a flexible printed circuit (FPC) is fixed to the second step structure 23 via a double-sided tape.

A projecting portion 24 having a flat upper surface is formed on a rear surface of the platform 21. The projecting portion 24 is a supporting pad covered with a metal layer that is electrically connected to the metal film constituting the stationary electrode 1 described previously. The metal layer is covered with an anisotropic conductive film (AFC) so as to allow the line of the flexible printed circuit (FPC) to be connected to the metal film, thereby imparting a potential to the stationary electrode. The anisotropic conductive film (ACF) contains metal particles and is known well to render two conductors electrically conductive when heat and pressure are applied thereto.

Slits 26 for aligning the cantilevers 3 and 7 with the platform by using a jig described herein later are formed on both sides in the rear portion of the platform 21. Also, through-holes 25 for aligning the cantilevers 2 and 6 with the platform 21 are formed in the rear portion of the platform 21. To be more specific, as described herein later, the projecting portion of the jig is engaged with the slit 26 so as to determine accurately the position of the cantilever 2 or 6 arranged on the jig relative to the platform 21, and the cantilever 2 or 6 is fixed to the step 22 of the platform 21 with an adhesive. Also, a pin (not shown) is inserted into the through-hole 25 of the platform 21 so as to permit the platform 21 to be aligned with another platform 21. Further, pins are successively inserted into the through-holes 25 of the platforms 21 such that the upper surface of the platform 21 is allowed to face the lower surface of another platform 21 so as to stack the platforms 21 one upon the other and, thus, to allow the cantilevers 2, 6 on each platform 21 to be aligned accurately with the cantilevers 2, 6 on another platform 21.

The method of manufacturing the movable film type display device shown in FIGS. 6 and 7 by using the platform 21 shown in FIG. 8 will now be described.

Figure 9A:
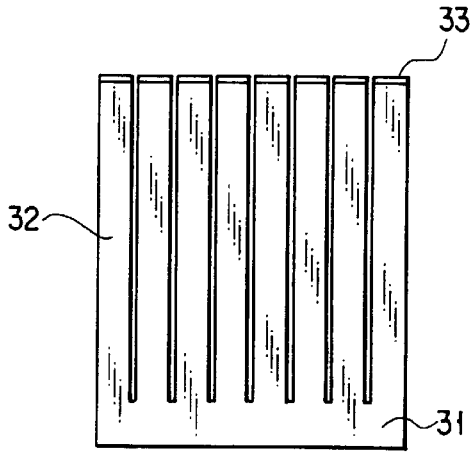
FIGS. 9A, 9B and 9C are drawings collectively showing the manufacturing method of a cantilever fixed to the platform shown in FIG. 8.

First of all, how to manufacture the cantilevers 2 and 6 will be described. As is apparent from the foregoing description, the cantilevers 2 and 6 are the most delicate members. It is necessary for all the cantilevers to be manufactured to exhibit the same electromechanical characteristics. As shown in FIG. 9A, prepared is a conductive film consisting of a PET (polyethylene terephthalate) film having the both surfaces covered with a thin aluminum layer, and the conductive film is cut so as to prepare a plurality of cantilever pieces 32. The tip 33 of the cantilever piece 32 is colored, for example, black before the film is cut. Also, the proximal end portion of the film is not coated with aluminum in advance to form a band-like section 31 made of the PET film portion alone. A series of the cantilever pieces 32 are held by the band-like section 31. The band-like section 31 is removed to prepare individual cantilevers 2 that are independent both electrically and mechanically, and these cantilevers 2 are mounted on the platform 21.

Figure 9B:
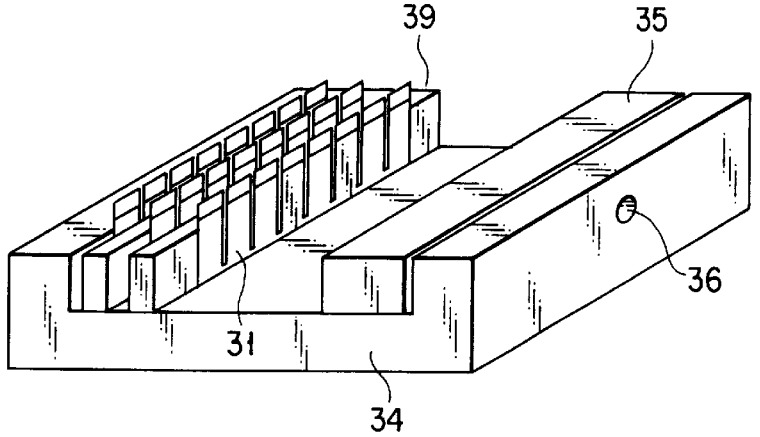
Figure 9C:
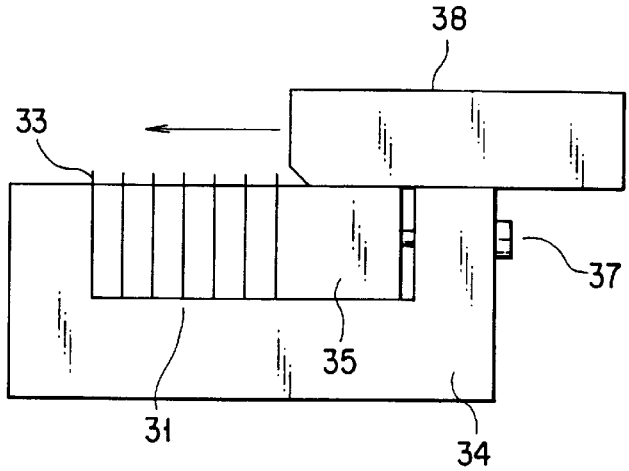

For preparing the tab 3 or 7 at the tip of the cantilever piece 32, the cantilever piece 32 is held by a jig 34 shown in FIG. 9B and the tip portion of the cantilever piece 32 is folded. The jig 34 shown in FIG. 9B is shaped like a box open on both sides, and a large number of rectangular rod-like blocks 39 for holding the cantilevers 32 are arranged within the jig 34. A screw groove 36 is formed in the side wall of the jig 34, and a push rod 37 is engaged with the screw groove 36. The push rod 37 is joined to a pressure block 35 arranged within the jig 34. Within the jig 34, the cantilever piece 32 is arranged between adjacent rectangular rod-like blocks 39 such that the colored tip portion of the cantilever piece 32, which is formed into the tab 3 or 7, projects from within the adjacent rectangular rod-like blocks 39. It is desirable for the height of the cantilever piece 32 including the band-like portion 31 at the proximal end portion to be larger than the height of the rectangular rod-like block 39 by the length of the colored tip portion that is formed into the tab 3 or 7 such that the colored tip portion alone projects outward from between the adjacent rectangular rod-like blocks 39. As shown in FIG. 9C, the pressure block 35 pushes the rectangular rod-like block 39 when the push rod 37 is moved forward, with the result that the cantilever piece 32 is held between the adjacent rectangular rod-like blocks 39 in preparation for the folding step of the tip of the cantilever piece 32.

The jig 34 is heated with the cantilever piece 32 held therein, and a weight having the surface coated with Teflon, i.e., a pressurizing member 38, is disposed on the jig 34. The weight 38 is slid along the rectangular rod-like blocks 35, 39 so as to fold the tip portion of the cantilever piece 32 by substantially 90°, thereby forming the folded tab 3 or 7. Then, the jig 34 is cooled to room temperature with the weight 38 disposed thereon under the state that the folded tab 3 or 7 is arranged on the rectangular rod-like blocks 35, 39. If the jig 34 is cooled to room temperature, the tip portion of the cantilever piece 32 is left folded so as to maintain the shape of the tab 3 or 7.

Figure 10:
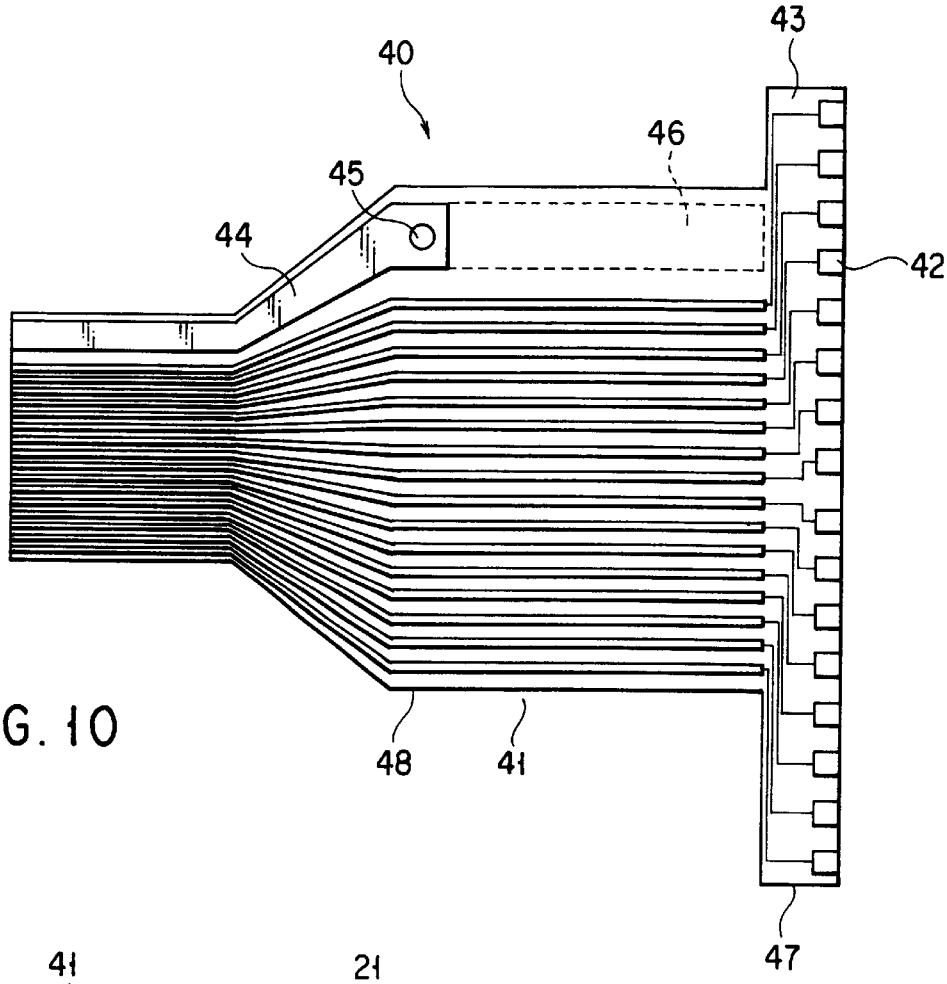
FIG. 10 is a plan view showing a flexible printed circuit (FPC) fixed to the platform shown in FIG. 8.

FIG. 10 shows a flexible printed circuit (FPC) 40 adapted for use together with the platform 21. The flexible printed circuit (FPC) 40 is formed of an ITO substrate 41. A conducting line 43 and contact tongue 42 are formed on one surface of the ITO substrate 41. The flexible printed circuit (FPC) 40 comprises a band-like section 47 having the width and length substantially equal to those of the step 23 of the platform 21 so as to be mounted on the step 23 of the platform 21, and an extended section 48 having a width adapted for the mounting to the clearance between the adjacent projecting portions formed on both sides in the rear portion of the platform 21. The contact tongues 42 are formed substantially equidistantly on the band-like section 47 of the flexible printed circuit (FPC) 40, and the conducting lines 43 are formed to extend from the contact tongues 42 over the band-like section 47 and the extended section 49. Also, a conducting line 44 is similarly formed on one surface of the ITO substrate 41 so as to be connected to a contact tongue 46 for the stationary electrode formed on the other surface via a through-hole 45. The contact tongue 46 is connected to a thin film of the platform 21 corresponding to the stationary electrode 1 via the projecting portion 24 on the platform 21. An anisotropic conductive film 53 is mounted on the band-like section 47 and the contact tongue 46 of the flexible printed circuit (FPC) 40 before mounted on the platform 21. To be more specific, the anisotropic conductive film is attached first to the contact tongue 46 for the stationary electrode that is brought into contact with the stationary electrode 1 and, then, is attached to the contact tongue 42 that is electrically connected to the cantilever piece 32.

Figure 11A:
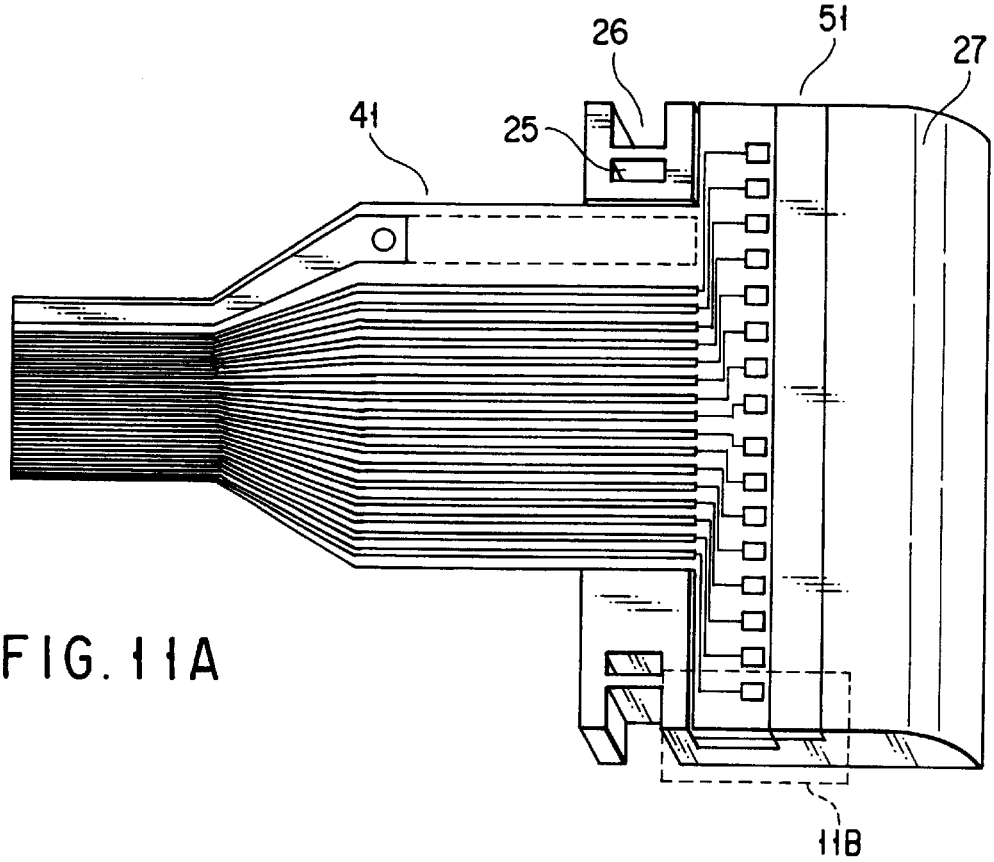
FIGS. 11A and 11B are oblique views showing the platform to which the flexible printed circuit (FPC) shown in FIG. 10 is fixed, FIG. 11B showing in a magnified fashion a part of the oblique view shown in FIG. 11A.
Figure 11B:
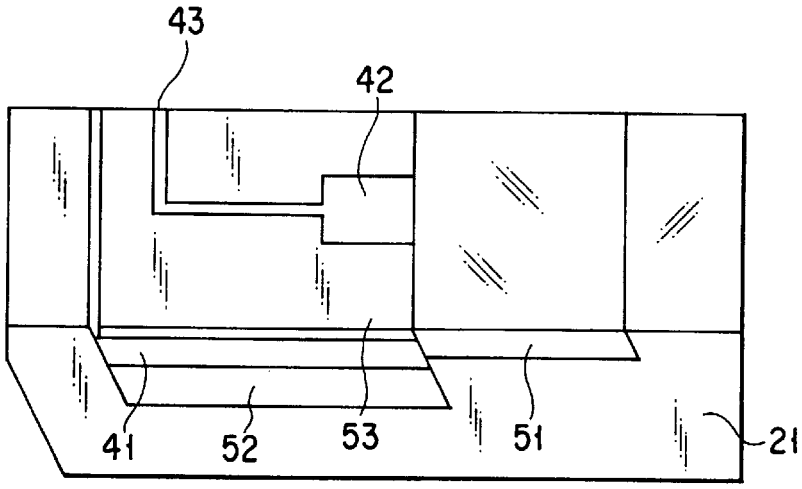

The flexible printed circuit (FPC) 40 is mounted on the platform 21 as shown in FIG. 11A. Specifically, double-sided tapes 51, 52 are mounted on the steps 22, 23 of the platform 21, and the contact tongue 46 for the stationary electrode mounted on the other surface of the flexible printed circuit (FPC) 40 is positioned on the projecting section 24 of the platform 21 so as to be fixed with an adhesive, as shown in FIG. 11B. Also, the band-like section 47 of the flexible printed circuit (FPC) 40 is bonded to the double-sided tape 52, and the surface of the anisotropic conductive film 53 of the band-like section 47, in which the contact tongue 42 is formed, is continuously brought into contact with the double-sided tape 51.

Figure 12:
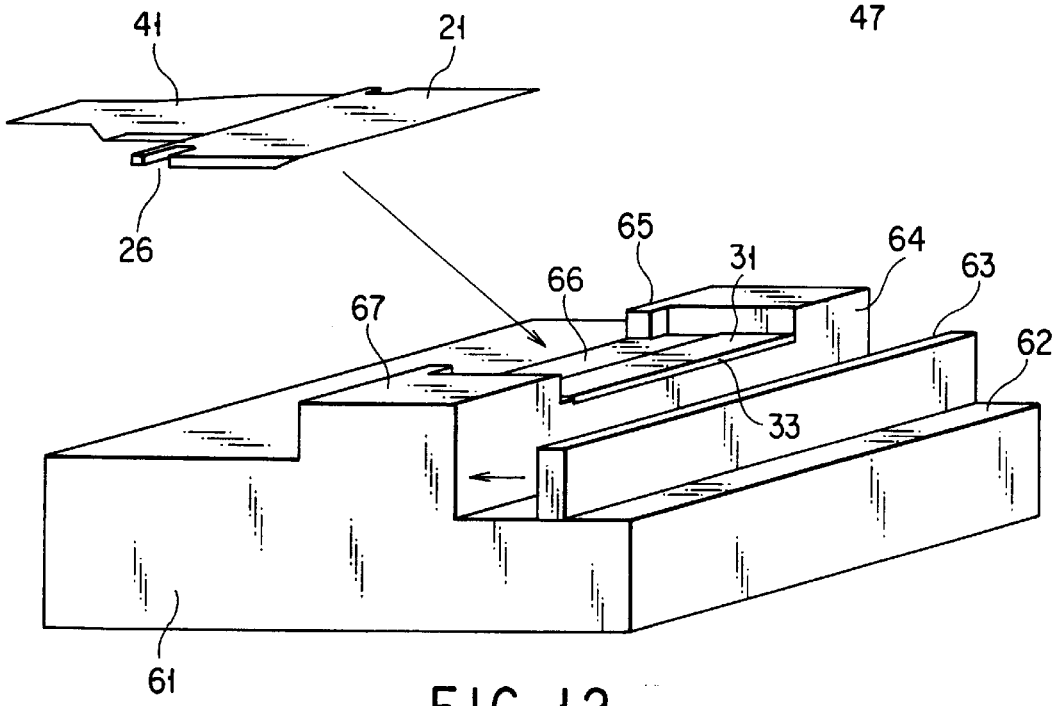
FIG. 12 is an oblique view showing the process of mounting a jig for fixing the cantilever to the platform shown in FIG. 11 and the process of mounting the platform to the jig.

The cantilever 2 is fixed to the platform 21, in which the flexible printed circuit (FPC) 40 is mounted, by using an assembling jig 61 as shown in FIG. 12. In realizing a movable film type display device, it is the to be most important to mount the cantilever piece 32 to the rigid platform 21 and to electrically connect the cantilever piece 32 to the contact tongue 42 on the platform 21. Since the cantilever piece 32 is very thin and the bending characteristics and the electrical response of the cantilever piece 32 are highly changeable in response to the deformation, the platform 21 is required to have a high quality having a flat surface so as not to generate warping or the like in the cantilever piece 32.

As already described with reference to FIGS. 9A to 9C, prepared is a structure in which a plurality of cantilever pieces 32 are supported by the band-like section 31. For accurately and efficiently fixing the cantilever pieces 32 to the platform 21, it is more desirable to fix the particular structure itself to the platform 21. As shown in FIG. 12, the jig 61 comprises side sections 67 defining a recess 66 adapted for the platform 21, and projections 65 for the position alignment, which are engaged with the slits 26 formed on both sides of the platform 21, are formed in the side sections 67. The recess 66 of the jig 61 is formed flat for arranging the cantilever piece 32 therein. Also, the jig 61 comprises a step 62, and a holding block 63 for holding the tab 3 or 7 of the cantilever piece 32 is slidably arranged in the step 62.

In order to fix the cantilever piece 32 to the platform 21, the cantilever piece 32 is arranged on the flat surface within the recess 66 such that the tab 3 or 7 at the tip of the cantilever piece 32 is brought into contact with a position aligning side wall 64 of the jig 61. Under this state, the holding block 63 is moved forward toward the side wall 64 so as to allow the tab 3 or 7 of the cantilever piece 32 to be held between the holding block 63 and the side wall 64. Under this state, that surface of the platform 21 on which the flexible printed circuit (FPC) is formed is allowed to face the jig 61, and the slits 26 formed on both sides of the platform 21 are engaged with the position aligning projections 65 of the jig 61. Then, the cantilever piece 32 is bonded to the double-sided tape 51 mounted on the platform 21. If the cantilever piece 32 is fixed to the platform 21 by the double-sided tape 51, the tab 3 or 7 of the cantilever piece 32 is released from the clearance between the holding block 63 and the side wall 64, and the platform 21 is taken out of the jig 61. In the platform 21 thus taken out, the cantilever piece 32 is positioned on the contact tongue 42 covered with an anisotropically conductive film. If heat and pressure is applied to the cantilever piece 32 under this state, the conductive layer within the cantilever piece 32 is electrically connected to the contact tongue 42 and is also fixed mechanically. Then, the band-like section 31 at the proximal end portion of the cantilever piece 32 is removed, with the result that independent cantilever pieces 32 are fixed to the platform 21.

Further, the stationary cantilever 7 is fixed with an adhesive to the platform 21 having the cantilever piece 32 mounted thereto as the movable cantilever 2. The stationary cantilever 6 is also prepared by the steps similar to those shown in FIGS. 9A to 9C and is mounted on the jig 61 shown in FIG. 12 so as to be fixed to the platform 21. The stationary cantilever 6 itself does not include an aluminum coating and does not perform the function of an electrode. It follows that, unlike the movable cantilever 2, the stationary cantilever 6 does have a mechanically and electrically separated structure. Therefore, it is possible for the stationary cantilevers 6 to be connected to each other by the band-like section at the proximal end portions as shown in FIG. 9A. It is also possible for the band-like section to be fixed to the platform 21 by the double-sided tape 51. Where the tab 7 of the stationary cantilever 6 is fixed to the platform 21, it is necessary to fix the stationary cantilever 6 such that the predetermined gap 5 is provided between the tab 3 of the movable cantilever 2 and the tab 7 of the stationary cantilever 6. Where the jig 61 is utilized for mounting the stationary cantilever 6 to the platform 21 having the movable cantilever 2 mounted thereto, the movable cantilever 2 abuts against the holding block 63. However, since the movable cantilever 2 itself is deformable, the movable cantilever 2 abutting against the holding block 63 is simply deformed, with the result that the movable cantilever 2 does not provide an obstacle in mounting the stationary cantilever 6 to the platform 21. Also, it is possible to prepare a spacer having a width corresponding to the predetermined gap 5 between the tab 7 of the stationary cantilever 6 and the tab 3 of the movable cantilever 2. In this case, the platform 21 having the movable cantilever 2 mounted thereto is fixed after the tab 7 of the stationary cantilever 6 is pressed against the side wall 64 by the spacer.

After a plurality of platforms 21 each having the movable cantilever 2 and the stationary cantilever 6 mounted thereto have been prepared, the pins (not shown) are inserted into the through-holes 25 of the platforms so as to align the positions of the plural platforms 21. It should be noted that the through-holes 25 of the plural platforms 21 are formed slightly deviated from each other by the distance corresponding to the gap 11. It follows that, in the combined platforms 21, the gap 11 described previously with reference to FIG. 5 is formed between the tab 7 and the tab 3 of the adjacent platforms 21.

As described above, a large number of platforms 21 whose positions are aligned are made integral by the pins so as to provide a display device operated by the principle shown in FIGS. 5 and 6.

The reflective film display device according to the embodiment of described above comprises the stationary cantilever 6 having the tab 7. However, it is not absolutely necessary to use the stationary cantilever 6 supporting the tab 7 as far as the background replacing the tab 7, which can be observed when the tab 3 at the tip of the movable cantilever 2 is shifted, is arranged. In other words, the present invention is not limited to the structure in which the tab 7 is supported by the stationary cantilever 6. Also, in the reflective film display device according to the embodiment described above, the tip 33 of the cantilever piece 32 is coated with an ink of the same color. However, it is also possible for the tip portion 33 of the cantilever piece 32 to be coated with inks of a plurality of colors. Where the tips 33 of a column of cantilever pieces 32 are coated with inks of two or three primary colors, and the tips 33 of the other cantilever pieces 32, which are fixed to the other platforms, are colored appropriately, it is possible to display images or the like with various colors by the tabs corresponding to the tips of the cantilever pieces 32 arranged in the row-column configuration, i.e., a grid like configuration. It is also possible to display images or the like with a variously changed brightness by making the vibration of the tabs variable.

As described above, the reflective film display device of the present invention is constructed to permit a large number of electromechanically movable structures to be stacked one upon the other accurately and efficiently, making it possible to manufacture efficiently the reflective film display device with a sufficiently high accuracy.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A reflective film display device including first and second display units to which a driving signal is supplied, the second display unit being stacked on the first display unit, and each of the first and second display units comprising:

a stationary electrode;

a plurality of movable cantilevers, each configured to be elastically deformed, electrically insulated from the stationary electrode, having a first free end and a movable display piece provided at the first free end, and being arranged to have a gap between the first free end and the stationary electrode;

a wiring board including conducting lines configured to supply the driving signal to the stationary electrode and the movable cantilevers;

a plurality of stationary cantilevers, each having a second free end and a stationary display piece provided at the second free end and arranged on the corresponding movable cantilever, the stationary display piece facing to the movable display piece with a gap between the stationary display piece and the movable display piece; and an alignment structure configured to align the second display unit with the first display unit, to hold the movable and stationary cantilevers substantially in an array and to fix the wiring board to the stationary electrode, said alignment structure including a first aligning member connecting the conducting lines to the stationary electrode and the movable cantilever and a second aligning member positioning the second display unit on the first display unit such that the movable and stationary display pieces of the first and second display units are arranged to form a grid, and the movable cantilever being bent upon application of the driving signal to the conducting lines such that the movable display piece of the second display unit is displaced to a position behind the stationary display piece of the first display unit.

2. The reflective film display device according to claim 1, wherein the alignment structure includes a first adhesive layer configured to fix the movable cantilevers and a first receiving section configured to receive the adhesive layer.

3. The reflective film display device according to claim 1, wherein the alignment structure includes a second adhesive layer configured to fix the wiring board and a second receiving section configured to receive the second adhesive layer.

4. The reflective film display device according to claim 2, wherein the alignment structure includes a first adhesive layer configure to fix the movable cantilevers, a first receiving section configured to receive the adhesive layer, a second adhesive layer configured to fix the wiring board and a second receiving section configured to receive the second adhesive layer.

5. The reflective film display device according to claim 1, wherein each of the conducting lines includes a first connecting section, each of the stationary electrode and the movable cantilevers includes a second connecting section, and said display device further includes anisotropic conductive films provided between the first and second connecting sections and connecting the connecting lines to the stationary electrode and the movable cantilevers, respectively.

6. A reflective film display device including first and second display units to which a driving signal is supplied, the second display unit being stacked on the first display unit, and each of the first and second display units comprising:

an alignment structure configured to align the second display unit with the first display unit;

a stationary electrode provided on the alignment structure;

movable cantilevers, each configured to elastically deformed and having a movable display piece at its free end, a first gap being formed between the free end of the movable cantilever and the stationary electrode, the movable cantilevers being fixed to the alignment structure;

stationary cantilevers, each mounted on the movable cantilever in conformity with the movable cantilever and having a stationary display piece provided at a free end, a second gap being provided between the movable and stationary display pieces; and a wiring configured to supply a driving signal to the stationary electrode and the movable cantilever, the wiring being aligned with the stationary electrode and the movable cantilever by the alignment structure, and the movable cantilever being elastically deformed to allow the movable display piece of the second display unit to be displaced to a position behind the stationary display piece of the first display unit.

* * * * *